US006685373B1

(12) United States Patent
Liu

(10) Patent No.: US 6,685,373 B1
(45) Date of Patent: Feb. 3, 2004

(54) MULTI-CARTRIDGE COLOR PEN

(76) Inventor: Chen Chou Liu, PO Box 82-144, Taipei (TW)

( * ) Notice: Subject to any disclaimer, the term of this patent is extended or adjusted under 35 U.S.C. 154(b) by 0 days.

(21) Appl. No.: 10/449,003

(22) Filed: Jun. 2, 2003

(51) Int. Cl.[7] ..... B43K 27/04; B43K 27/08
(52) U.S. Cl. ..... 401/35; 401/34
(58) Field of Search ..... 401/28, 34, 35; D19/36

(56) References Cited

U.S. PATENT DOCUMENTS 3,164,906 A * 1/1965 Andaloro ..... 401/35
6,554,517 B2 * 4/2003 Ahmed ..... 401/35
D476,362 S * 6/2003 Whitehorn ..... D19/36

* cited by examiner

*Primary Examiner*—Tuan N. Nguyen
(74) *Attorney, Agent, or Firm*—Leong C. Lei

(57) ABSTRACT

An improved structure of a multi-cartridge color pen comprised of a hollow barrel, a seat and a base cover, wherein, multiple insertion holes being provided to the base, multiple separators each with a point bottom protruding from the lower edge of the base; multiple sleeves in parallel with one another each containing a cartridge in different color from one another to prevent mixture of colors; a nib being inserted into the hole of the base for drawings lines in different colors.

2 Claims, 3 Drawing Sheets

MULTI-CARTRIDGE COLOR PEN

BACKGROUND OF THE INVENTION (a) Field of the Invention

The present invention is related to an improved structure of a multi-cartridge color pen, and more particularly, to one allows drawing of lines in different colors at the same time, and faster and easier process and assembly.

(b) Description of the Prior Art

As illustrated in FIG. 1 of the accompanying drawings of the present invention, a multi-cartridge color pen 1 of the prior art is comprised of a barrel 11 and a base 12 with the barrel 11 containing multiple cartridges 13 each provided with a nib 13. The base 12 and the barrel 11 being inserted into each other and fixed allowing those cartridges 13 to contact their respective nibs 14 to draw multiple lines in different colors at the same time. Upon assembling, those cartridges 13 are first placed into the barrel 11, without any separation and fixation in position. Therefore, it prevents easy process and those cartridges 13 are vulnerable to be contaminated among one another resulting in mixture of colors. Furthermore, it is also difficult to segregate those cartridges 13 upon placing the base 12 into the barrel 11 to create the bottleneck in the manufacturing process that frustrates any attempt of improving the production efficiency.

Therefore, it is an object of the present invention to provide an improved structure of a multi-cartridge color pen which can obviate and mitigate the above-mentioned drawbacks.

SUMMARY OF THE INVENTION

The primary purpose of the present invention is to provide an improved structure of a multi-cartridge color pen that permits easier process and assembly to improve production efficiency and prevent mutual contamination of colors among cartridges for quality assurance of the color pen. To achieve the purpose, the present invention is comprised of a hollow barrel, a base and a base cover. Wherein, multiple insertion holes are provided to the base and multiple separators protrude from the lower edge of the base with each having a point bottom; and the base cover to separate multiple cartridges placed into respective sleeves to prevent mixture of colors among those cartridges. The bottom of the separate is point to allow easier assembly by separating the cartridges. The top of the barrel is graded to receive the insertion of a retaining ring to secure the connection between the base and barrel.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
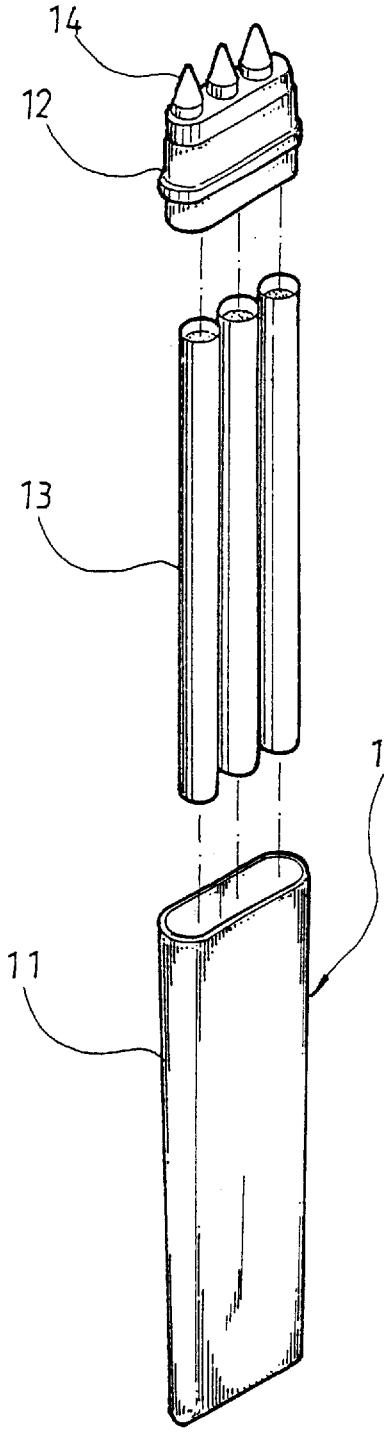
PRIOR ART FIG. 1
FIG. 1 is an exploded view of a multi-cartridge color pen of the prior art.
Figure 2:
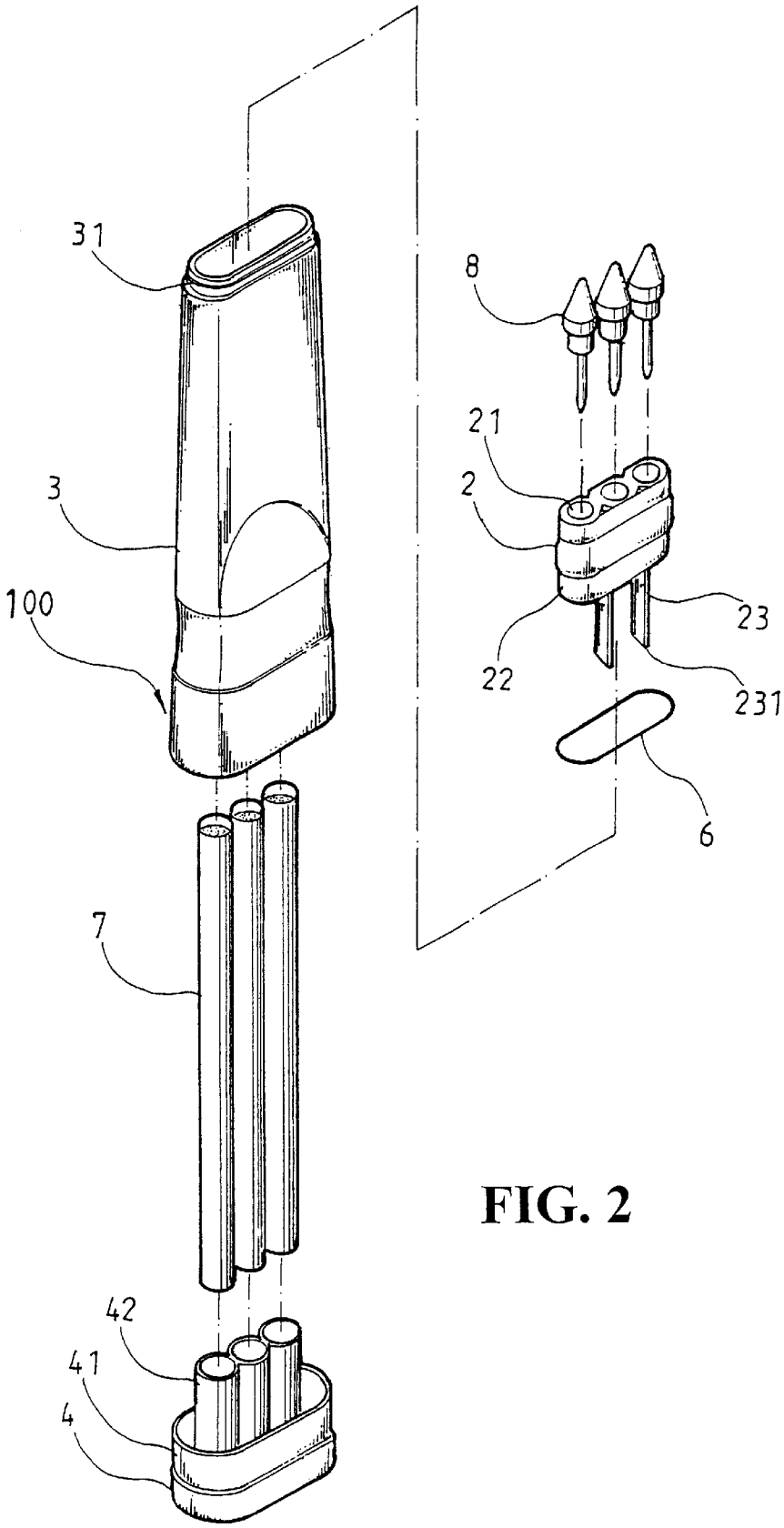
FIG. 2 is an exploded view of a preferred embodiment of the present invention.
Figure 3:
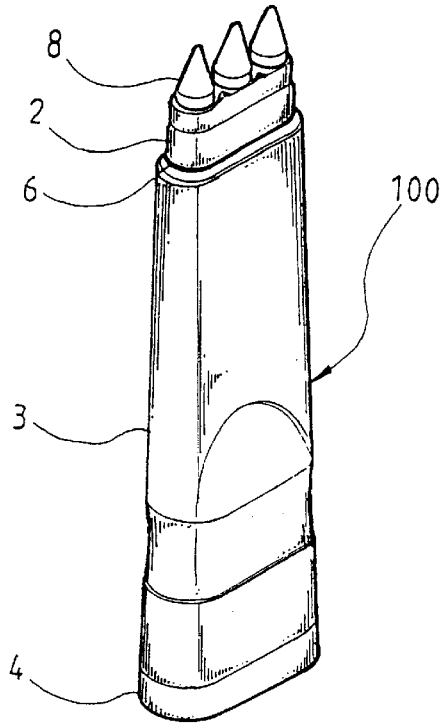
FIG. 3 is a perspective view of the preferred embodiment of the present invention.

Referring to FIGS. 2 and 3, a preferred embodiment of the present invention is comprised of a base 2, a hollow barrel 3, and a base cover 4. Wherein, the base 2 is provided with multiple insertion holes 21 and a deck 22 slightly narrower than the body of the base is provided below for insertion into the hollow barrel 3. Multiple separators 23 protruding downward from the lower edge of the insertion deck 22 and each separator 23 is provided at its lower end a point 231.

A gradation 31 is provided at the top of the hollow barrel 31 to receive the insertion of a waterproof retaining ring 6. Another gradation 41 is provided to the base cover 4 to receive the insertion of the lower end of the hollow barrel 3, and multiple sleeves 42 arranged in parallel to one another protrude upward for a proper length from the inner edge of the base cover 4.

Multiple cartridges 7 in different colors from one another are inserted into those multiple sleeves 42 of the base cover. Multiple nibs 8 equally numbered with that of those cartridges 7 are placed into their respective insertion holes 21 of the base 2. The base 2, the barrel 3 and the base cover 4 are assembled to form a multi-cartridge color pen 100 for drawing multiple lines in different colors at the same time.

In the process of assembling the multi-cartridge color pen 100, those cartridges 7 are placed into their respective sleeves 42 of the base cover 4. Those sleeves 42 are provided in proper height for each of those cartridges 42 to be respectively fixed in place and separated from one another to prevent mixture of colors. Once the base 2 inserted with those nibs 8 is inserted into the barrel 3, those separators 23 protruding in proper length from the lower edge of the base 2 easily separate those cartridges from one another to secure each nib 8 in its corresponding cartridge 7 ensuring easy and fast assembly process for improving production efficiency.

Figure 4:
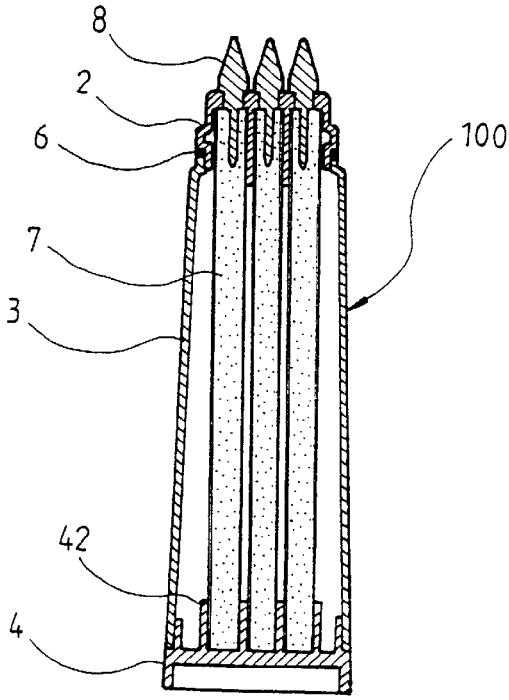
FIG. 4 is a sectional view of the preferred embodiment of the present invention.

Now referring to FIG. 4 for the assembly of the preferred of present invention, those cartridges are fixed in their respective sleeves 42 of the base cover to prevent contamination or mixture of colors among one another. Once the base 2 is inserted into the barrel 3, those separators 23 protruding downward from the deck 22 of the base 2 separate those cartridges 7 at their tops to ensure that all those cartridges 7 are securely engaged with their respective nibs 8 to facilitate the writing and/or drawing without interruption of the ink.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a multi-cartridge color pen comprising: a hollow barrel with a graded top; a seat provided with multiple insertion holes to receive corresponding nibs, and multiple separators each having a point bottom protruding downward for a proper length from the lower edge; and a base cover containing multiple sleeves each protruding upward for a proper length characterized by that those multiple sleeves being provided to receive insertion of multiple cartridges in different colors from one another, corresponding multiple nibs being inserted into those insertion holes provided at the seat to constitute a multiple-cartridge color pen comprised of the base, the sleeves and the base cover to allow faster and easier assembly by means of those point separators, base cover and those sleeves while preventing mixture of colors among those cartridges.

2. The structure of a multi-cartridge color pen as claimed in claim 1, wherein, a retaining ring is fixed to the graded top of the barrel to prevent overflow of ink in each cartridge when the seat is connected with the barrel.

* * * * *